United States Patent [19]

Inowa et al.

[11] 4,197,568

[45] Apr. 8, 1980

[54] CORONA GENERATING APPARATUS

[75] Inventors: Shigeru Inowa, Hino; Katsuhiro Syukuri, Hachioji, both of Japan

[73] Assignee: Konishiroku Photo Industry Co., Ltd., Tokyo, Japan

[21] Appl. No.: 915,969

[22] Filed: Jun. 15, 1978

[30] Foreign Application Priority Data

Jun. 20, 1977 [JP] Japan ..... 52-79760[U]

[51] Int. Cl.[2] ..... H01T 19/00

[52] U.S. Cl. ..... 361/230; 361/229; 361/212

[58] Field of Search ..... 361/229, 230, 231, 235, 361/212, 214

[56] References Cited

U.S. PATENT DOCUMENTS

| | | | |
|---|---|---|---|
| 3,660,656 | 5/1972 | Frank et al. | 361/235 |
| 3,742,237 | 6/1973 | Parker | 361/230 |
| 3,862,420 | 1/1975 | Banks et al. | 361/230 |
| 3,976,880 | 8/1976 | Brunelle et al. | 361/229 |

FOREIGN PATENT DOCUMENTS

| | | | |
|---|---|---|---|
| 7414927 | 4/1975 | Netherlands | 361/230 |

OTHER PUBLICATIONS

*Research Disclosure* Feb. 1974; pp. 28, 29.

*Primary Examiner*—J. D. Miller
*Assistant Examiner*—L. C. Schroeder
*Attorney, Agent, or Firm*—Lane, Aitken & Ziems

[57] ABSTRACT

A corona generating apparatus for use in an electrophotographic copying machine is disclosed, which includes an elongated shield of a conductive net member defining an open ended chamber and a corona discharge electrode mounted in the chamber. The conductive net may be backed by a conventional conductive shield plate.

7 Claims, 5 Drawing Figures

PRIOR ART

CORONA GENERATING APPARATUS

BACKGROUND OF THE INVENTION

This invention relates generally to an electrophotographic copying machine, and more particularly to a corona generating apparatus useful for charging a photoconductive surface to a substantially uniform potential, for electrostatically transferring a toner image from the photoconductive surface to a transfer sheet, or for neutralizing the charge on the photoconductive conductive surface.

Conventional corona generators used heretofore in electrophotographic copying machines include the corotron type schematically shown in a sectional view of FIG. 1(*a*) and the scorotron type shown in FIG. 1(*b*). In each of the generators, a high a-c or d-c voltage is applied to one or more corona discharge electrodes 1 composed of metallic thin wires such as tungsten to generate corona ions around the peripheries thereof, and the ions are emitted toward the open side of a shield 2 which is composed of a metallic plate such as aluminum and surrounds the corona discharge electrodes 1 so as to shield the electric field of the discharge electrodes, thereby creating a corona current flow from the electrodes to a nonconductive member spaced therefrom for charging or discharging. Although the corotron type is suited to offer a high ion emission density, it is deficient in attaining uniformity and stability in ion emission density. And also, in the scorotron type, there is difficulty in ensuring a high emission density though its uniformity is improved by the provision of a grid 3 on the open side of the shield electrode 2.

In the scorotron type as well as in the corotron type, the performance achievable is not satisfactory in charging and discharging a photosensitive medium of, for example, an electrophotographic copying machine where high uniformity and stability are important requisites with respect to the ion emission density. And particularly a great problem exists in that the uniformity is reduced with the lapse of operation time.

SUMMARY OF THE INVENTION

The present invention has been accomplished as a result of our studies finding that the main reason for failure in maintenance of stability in the conventional corona generators resides in the following. Since the surface of the shield surrounding the corona discharge electrodes is formed smooth, there occurs a conspicuous edge effect at the circumferential plate edge around the open side of the shield, so that the ions and dust cannot be attracted uniformly onto the shield surface, and particularly deposition of dust on the shield is concentrated at the edge effect or in the vicinity of the corona discharge electrode. And the accumulated dust further increases the edge effect to cause acceleration of the deposition, thereby rapidly reducing the uniformity of the ion emission density. Further, interior surfaces of conventional shields tend to be injured during operation to form irregular flaws which also cause lowering of the uniformity of the ion emission.

The present invention provides a corona generating apparatus including an elongated shield of a conductive net member defining an open ended chamber and one or more corona discharge electrodes mounted in the chamber.

The present invention resides in employing a conductive net member for the surface of the shield electrode opposed to the corona discharge electrodes. In this structure, the latticework of the net member surface performs an averaging action with respect to attraction of ions and dust, so that deposition of the dust occurs uniformly on the net member surface hence offering a remarkable advantage in that the uniformity is not reduced rapidly with the lapse of operation time of the corona generator.

The net member, preferably of metallic wire, may be provided on the inner surface of a shield plate of a conventional corona generator and opposite the corona discharge electrodes. In this case, the influence of the edge effect or surface scratch of the backing plate is negligible due to the presence of the net member. The shield plate is preferably formed with a plurality of openings so that ozone-containing air in the chamber, which adversely affects a photoconductive surface, may be emitted therethrough the net member. If such openings are formed in the conventional shield electrode, the edge effect appears also at the circumferential edge of each opening to cause a great loss in the uniformity of the ion emission density while rendering the concentration of dust accumulation more conspicuous to reduce the stability. Thus, there has been a problem heretofore that deterioration of the discharger performance is unavoidable in removal of the undesirable air. However, the above problem is completely solved in the present invention where a net member is provided inside.

Accordingly, it is an object of the present invention to provide a corona generating apparatus which is devoid of the defects involved in the prior art apparatus.

Another object of the present invention is to provide a corona generating apparatus which ensures uniform and stable ion emission for a long service period.

It is a special object of this invention to provide a corona generating apparatus which is capable of exhausting undesirable air of a high ozone concentration generated as a result of corona discharge.

BRIEF DESCRIPTION OF THE DRAWING

Other objects, features and advantages of the present invention will become apparent from the detailed description of the preferred embodiment which follows, when considered in light of the accompanying drawing, in which.

DETAILED DESCRIPTION OF THE PREFERRED EMBODIMENTS OF THE INVENTION

Figure 3:
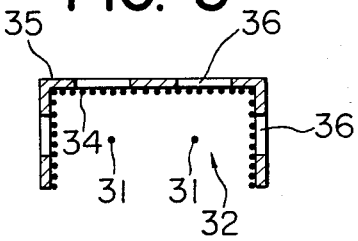
Figure 4:
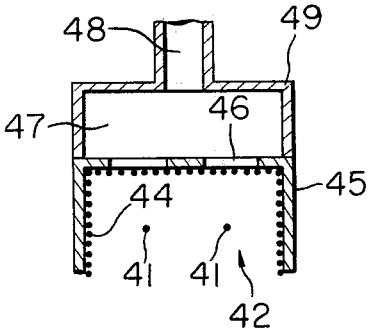
Figure 5:
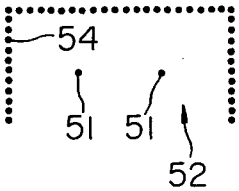

FIGS. 2 through 5 depict schematically corona generating apparatus. Referring first to FIG. 5, the corona generating apparatus includes an elongated shield 54 defining an open ended chamber 52. The shield 54 is formed of a conductive net having a mesh size (Tyler) of generally from 10 to 600-mesh, preferably from 20 to 200-mesh. It is preferred that the shield 54 is formed of a woven 20- to 200-mesh wire of stainless steel for reasons of durability and shape preservation. A screen sheer of carbon fiber or a metallic perforated sheet, for example, may also be used as the conductive net. Preferably, the shield 52 is formed in a U-shaped or semicircle configuration.

One or more corona discharge electrodes 51 are mounted in the open ended chamber 52, extending in a longitudinal direction from one end of the shield 54 to the other end thereof. The electrodes 51 are attached, by any suitable means, to either end plate (not shown) of the shield 54. The electrodes 51 are preferably made from fine metal wires such as tungsten.

By exciting the corona emitting wires 51 by means of a corona generator means or a suitable high voltage source (not shown), corona current flows from the electrodes to, for example, a photoconductive surface (not shown) placed to be spaced from and facing the open end portion of the shield.

Figure 2:
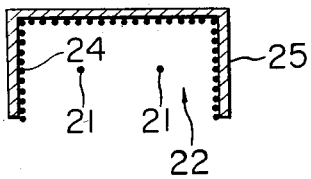
FIGS. 2 through 5 are cross sectional views schematically showing embodiments of corona generating apparatus according to the present invention.

FIGS. 2 through 4 show modification of the corona generating apparatus of FIG. 5, in which numerals 21, 22 and 24; 31, 32 and 34; and 41, 42 and 44 indicate the same components as 51, 52 and 54 in FIG. 5, respectively.

In the embodiment of FIG. 2, a conductive net shield 24 is backed by a conventional shield plate made from metal, for example, aluminum. In the apparatus of FIG. 3, a metal plate 35 surrounding a net member 34 is formed with a plurality of openings 36 so that ozone-containing air in chamber 32 may escape from the apparatus therethrough. In order to forcedly effect such air exhaustion, a duct is suitably connected to the openings of the metal plate. This is illustrated, by way of example, in FIG. 4, in which a metal plate 45 surrounding a conductive net shield 44 is provided with a plurality of openings 46 in its top, and a cover plate 49 is mounted on the top of the metal plate 45 to cover the openings entirely and to define a space 47 therebetween. The space 47 has an outlet port 48 from which ozone-containing air in a chamber 42 is exhausted via openings 46.

It is desirable that the corona discharger of the present invention be of the corotron type because a high corona-ion emission density is attainable with facility and excellent uniformity and stability are ensured. But even in the case of the scorotron type, it is still possible to achieve sufficiently high uniformity and enhanced stability.

EXAMPLE

Figure 1:
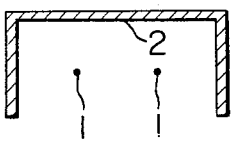
FIG. 1 PRIOR ART
FIG. 1(*a*) and (*b*) show conventional corona generating apparatus.
Figure 1:
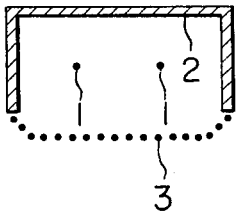
FIG. 1 PRIOR ART

Experiments were conducted by using, as a charger for a photoconductive member in an electrophotographic copying machine, a conventional corona generating apparatus illustrated in FIG. 1(*a*) and a corona generating apparatus of the present invention shown in FIG. 2, and the copies obtained were compared with each other. As the conductive net member 24, stainless steel net having a mesh size of 50-mesh was used.

The conditions in the experiments were set as follows. The shape and dimensions of shield were the same in both generators. The distance from the discharge electrodes to the shield electrode was 9 mm; the space between the discharge electrodes 10 mm; the distance from the discharge electrodes to the photosensitive medium of zinc oxide 9 mm; and the peripheral speed of the photoconductive surface passing through the corona generators was 20 cm/sec. After each electrostatic latent image was formed by exposing one original image to irradiation under the same conditions, the latent image was processed by toner development under the same conditions and then was transferred under the same conditions to a transfer sheet. The results obtained are shown in the table below.

| Evaluation of image unevenness | | | |
|---|---|---|---|
| Voltage applied to discharge electrode (kV) | −5.0 | −5.5 | −6.0 |
| Discharger of this invention | Δ | ○ | ○ |
| Conventional discharger | X | X | Δ |

(Notes):
○: No unevenness
Δ: Slight unevenness observed
X: Streaky unevenness observed As is obvious from the above, the corona discharger according to the present invention excels in uniformity. Also in the comparison regarding long-time copying operation, the copy obtained by the use of this invention indicated the same high stability as given in the table, whereas the one according to the conventional discharger showed streaky unevenness at the applied voltage of −6.0 kV.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In an electrophotographic copying machine, a corona generating apparatus comprising an elongated shield of a substantially conductive net member defining a latticework and shaped to form an open-ended chamber, said open end facing a photoconductive surface, and at least one corona discharge electrode mounted in said chamber.

2. A corona generating apparatus comprising:

a metal plate member defining an open-ended chamber;

a shield of substantially conductive net member lining the entire chamber and defining a latticework, said shield having an opening concurrent with the opening of said chamber; and at least one corona discharge electrode mounted within the net-lined chamber.

3. A corona generating apparatus as claimed in claim 2, wherein said plate member has a plurality of openings so that air in said chamber may be emitted from the apparatus through said net member and said openings.

4. A corona generating apparatus as claimed in claim 3, further comprising a cover member mounted on said plate member to entirely cover the openings of said plate member and to define a space therebetween, said space being provided with an air outlet port so that air in said chamber may be exhausted from the apparatus through said net member, said space and said outlet port.

5. The corona generating apparatus as defined by claim 1, 2, 3 or 4, wherein said net member has a mesh size of from 20 to 200-mesh.

6. A corona generating apparatus as claimed in claim 5, wherein said net member is formed of stainless steel.

7. The apparatus of claim 1 or 2 wherein said net member is an open-mesh metal wire screen, a screen sheer of carbon fiber or a perforated metallic sheet.

* * * * *